US006120030A

United States Patent [19]

Chou

[11] Patent Number: 6,120,030

[45] Date of Patent: Sep. 19, 2000

[54] TABLETOP HAVING MULTIPLE INDOOR GAME LAYOUTS

[76] Inventor: Taylor Chien-Tai Chou, No. 315, Tung-Hsing Road, Hsi-Tun Dist., Taichung City, Taiwan

[21] Appl. No.: 09/004,733

[22] Filed: Jan. 9, 1998

[51] Int. Cl.[7] ..... A63F 9/00; A47B 25/00

[52] U.S. Cl. ..... 273/284; 273/287; 273/309

[58] Field of Search ..... 273/309, 284, 273/283, 287

[56] References Cited

U.S. PATENT DOCUMENTS 161,502 3/1875 Gilbert ..... 273/284

527,279 10/1894 Green ..... 273/284

1,044,309 11/1912 Waldo ..... 273/284

*Primary Examiner*—Benjamin H. Layno

*Attorney, Agent, or Firm*—McDermott, Will & Emery

[57] ABSTRACT

A tabletop having multiple indoor game layouts includes a base member and a cover member. The base member has a bottom wall provided with a first indoor game layout thereon, and a surrounding wall extending upwardly from a periphery of the bottom wall. The cover member is mounted detachably on the surrounding wall and has one side provided with a second indoor game layout. The tabletop further includes a board member disposed horizontally and removably inside the base member and provided with a third indoor game layout.

5 Claims, 5 Drawing Sheets

TABLETOP HAVING MULTIPLE INDOOR GAME LAYOUTS

BACKGROUND OF THE INVENTION

1. Field of the Invention

The present invention relates to a tabletop, and more particularly to one having multiple indoor game layouts.

2. Description of the Related Art

It is known to provide the tabletop of a table with a specific indoor game layout for entertainment purposes. The known game tables, however, permit the user to play only a limited number of indoor games thereon. In order to have more choices, a variety of game tables with different indoor game layouts are needed in a game room to satisfy people in the same and to provide diverse entertainment. For a small-sized game room, the space for the game tables and hence the number of the game tables, is limited, thereby reducing the practical use and benefits of the game room. For a house with no game room, only one game table is usually allowed in the living room and thus, only a small number of indoor games can be played thereon.

SUMMARY OF THE INVENTION

The object of this invention is to provide a tabletop having multiple indoor game layouts. When the tabletop is mounted on a leg assembly to form a table, such a table does not only serve the function of a common table, but can also be used for playing different indoor games, thereby resulting in diverse entertainment within a limited space.

According to this invention, a tabletop includes a base member and a cover member. The base member has a bottom wall provided with a first indoor game layout thereon, and a surrounding wall extending upwardly from a periphery of the bottom wall. The cover member is mounted detachably on the surrounding wall and has one side provided with a second indoor game layout. The tabletop further includes a board member disposed horizontally and removably inside the base member and provided with a third indoor game layout. When the cover member engages the surrounding wall to form an integral unit, the tabletop can cooperate with a leg assembly to perform the general function of a conventional table. When the cover member is turned upside-down or removed from the base member, the tabletop offers a choice for playing two different indoor games. The board member can be removed from the base member to permit playing of another indoor game. Thus, multiple indoor games can be played with the use of the tabletop of this invention to achieve diverse entertainment within a limited space.

BRIEF DESCRIPTION OF THE DRAWINGS

The features and advantages of the present invention will be described in more detail with reference to the accompanying drawings which illustrate the preferred embodiment of this invention, wherein.

DETAILED DESCRIPTION OF THE PREFERRED EMBODIMENTS

Figure 1:
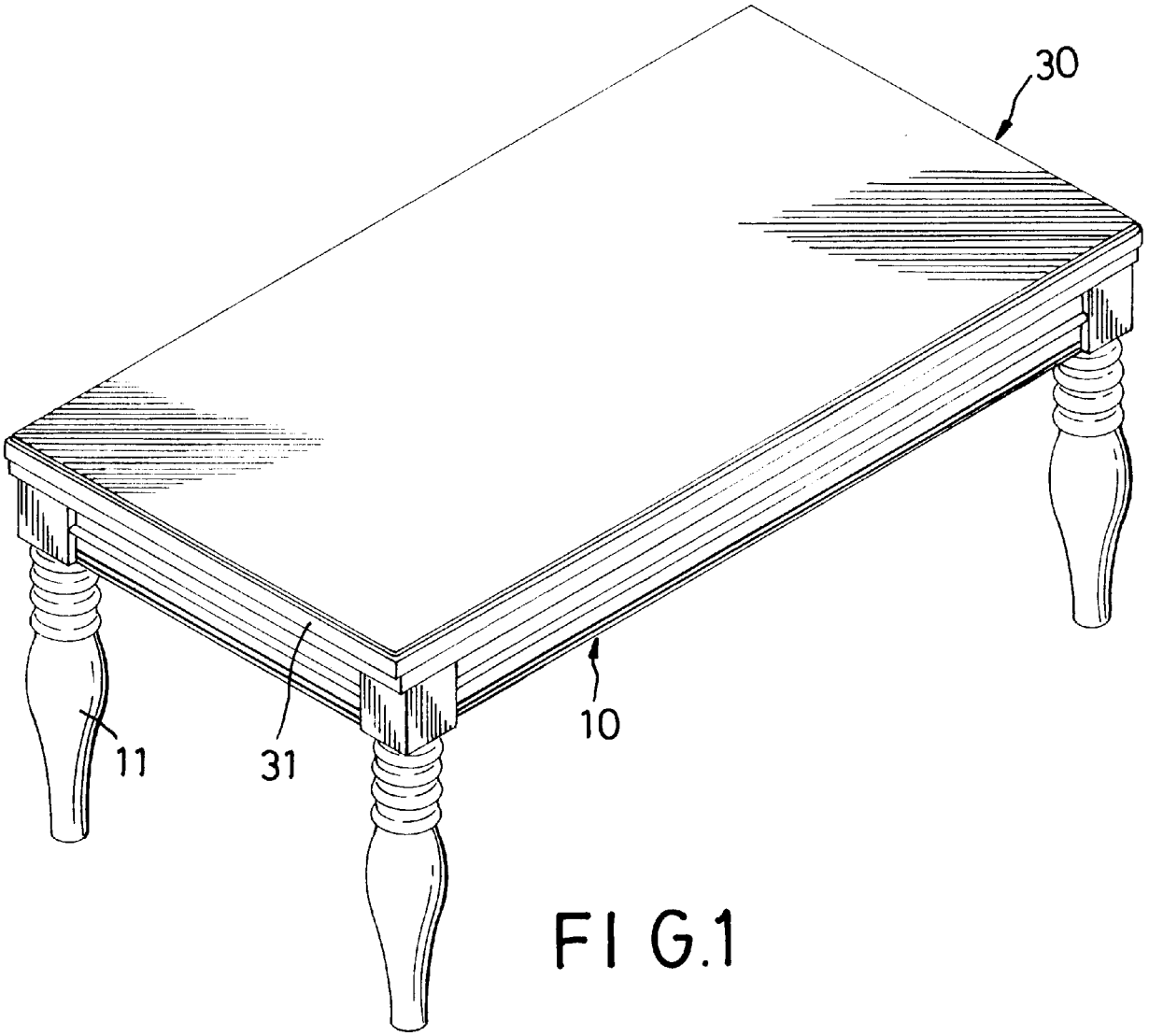
FIG. 1 shows a perspective view of the preferred embodiment of a tabletop according to this invention.
Figure 2:
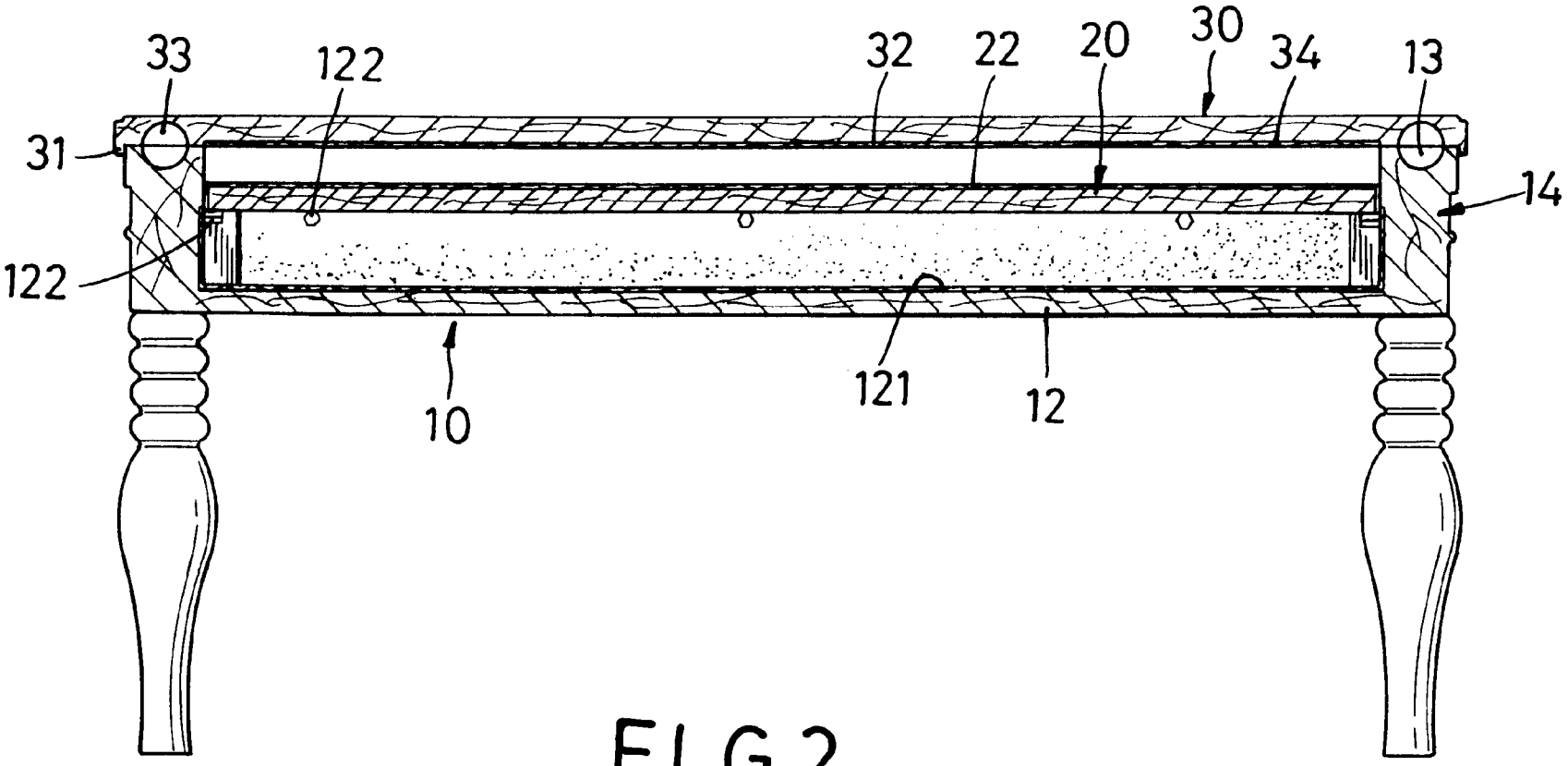
FIG. 2 shows a cross-sectional view of the tabletop of the preferred embodiment.

Referring to FIGS. 1 and 2, the preferred embodiment of a tabletop 10 according to this invention is shown to be installed on a leg assembly 11 in a conventional manner to form a table. The tabletop 10 includes a base member having a bottom wall 12 and a surrounding wall 14, and a cover member 30. The tabletop 10 further includes a board member 20 horizontally and removably supported inside the base member by supporting means 122, such as a plurality of posts that project inwardly from the surrounding wall 14 to support the board member 20 thereon. As clearly seen in FIG. 2, the cover member 30 is formed with a peripheral rim flange 31 that extends from the bottom side 34 of the cover member 30 for engaging removably the surrounding wall 14. When the cover member 30 is mounted on the surrounding wall 14, the peripheral rim flange 31 is fitted securely on the top end portion of the surrounding wall 14 to form a common table for general use. Flannel layers 32, 22, 121 are respectively provided on the bottom side 34 of the cover member 30, the upper side of the board member 20, and the upper side of the bottom wall 12. Preferably, a flannel layer is also provided between the bottom wall 12 and the board member 20 on the inner surface of the surrounding wall 14.

Figure 3:
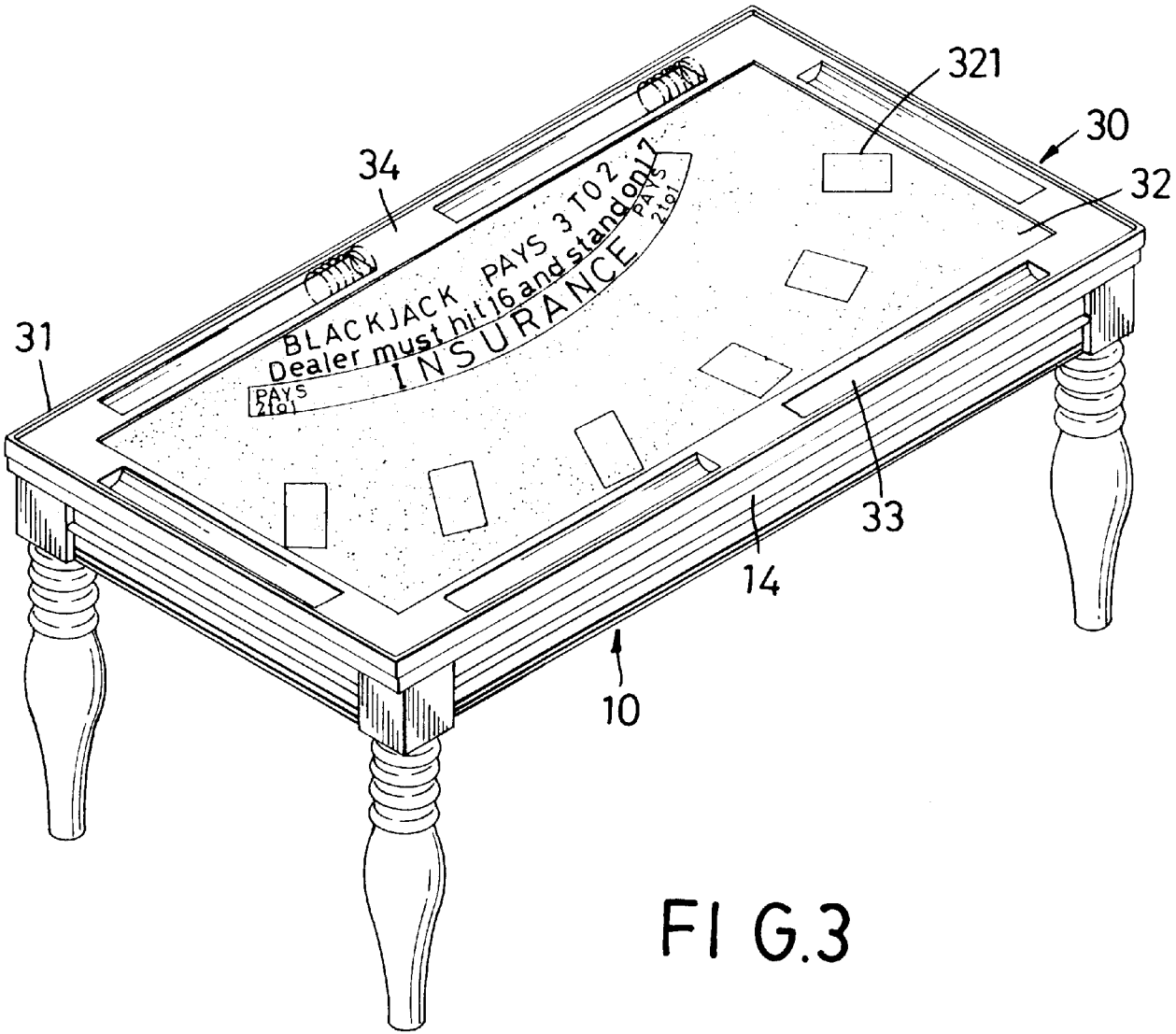
FIG. 3 illustrates one use of the tabletop of the preferred embodiment.

Referring to FIG. 3, there is shown a first use of the tabletop 10 of this invention. The cover member 30 of the tabletop 10 is turned upside-down and is placed on the surrounding wall 14. In the upside-down position of the cover member 30, an indoor game layout 321 provided on the flannel layer 32 is shown, through which an indoor game can be played. Tokens or game pieces used when playing the indoor game can be received in a number of cavities 33 that are formed on the bottom side 34 of the cover member 30.

Figure 4:
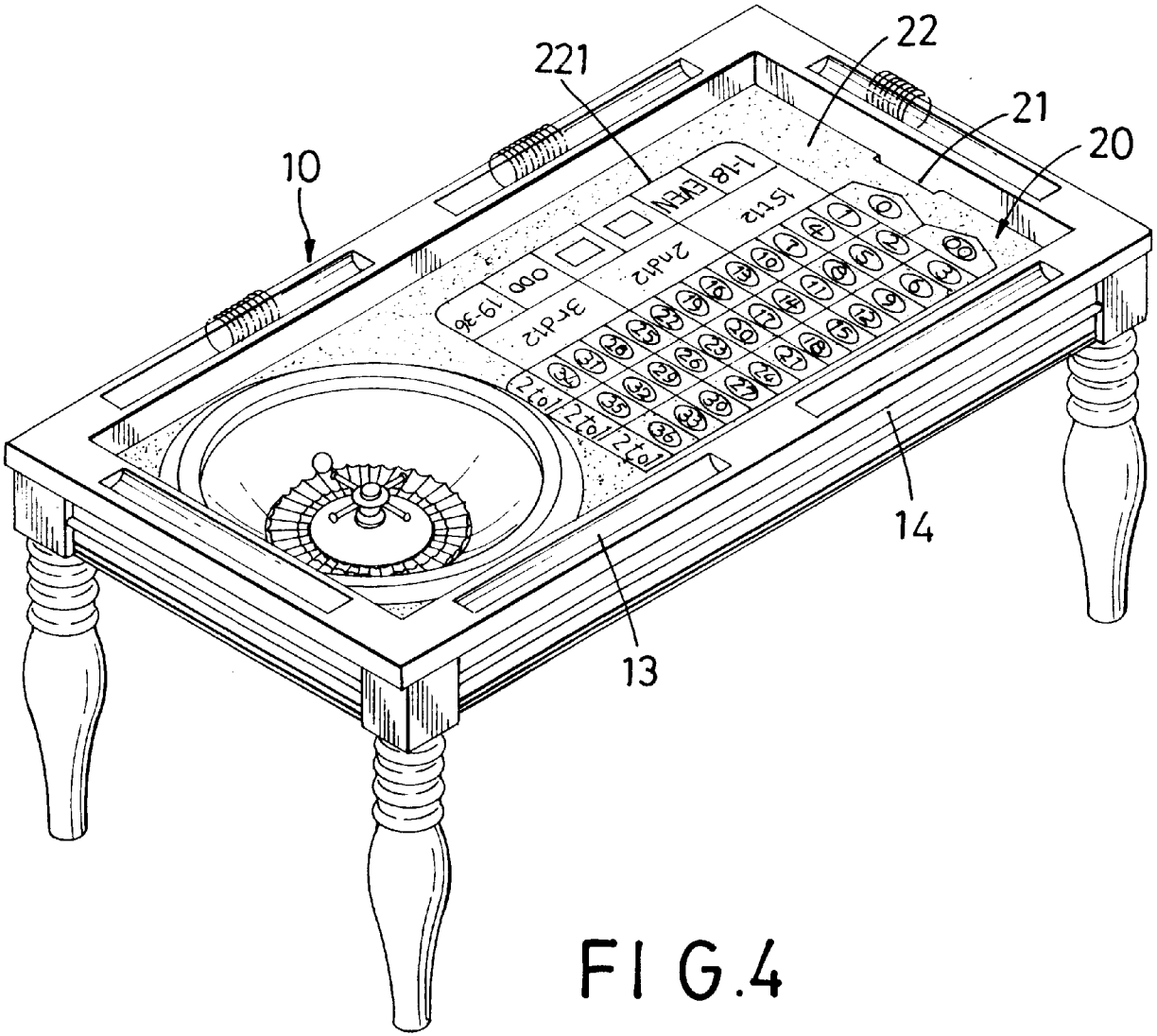
FIG. 4 illustrates another use of the tabletop of the preferred embodiment.

In FIG. 4, there is shown another use of the tabletop 10, wherein the cover member 30 is removed, and an indoor game layout 221 provided on the flannel layer 22 of the board member 20 is shown, thus permitting the playing of another indoor game. A number of cavities 13 are formed in a distal top end face of the surrounding wall 14 for receiving tokens or game pieces therein. Preferably, the cavities 13 are aligned with the cavities 33 on the cover member 30 when the cover member 30 is mounted on the surrounding wall 14, as shown in FIG. 2. The board member 20 further has opposite sides formed with a respective notch 21 to facilitate removal of the board member 20 from the base member.

Figure 5:
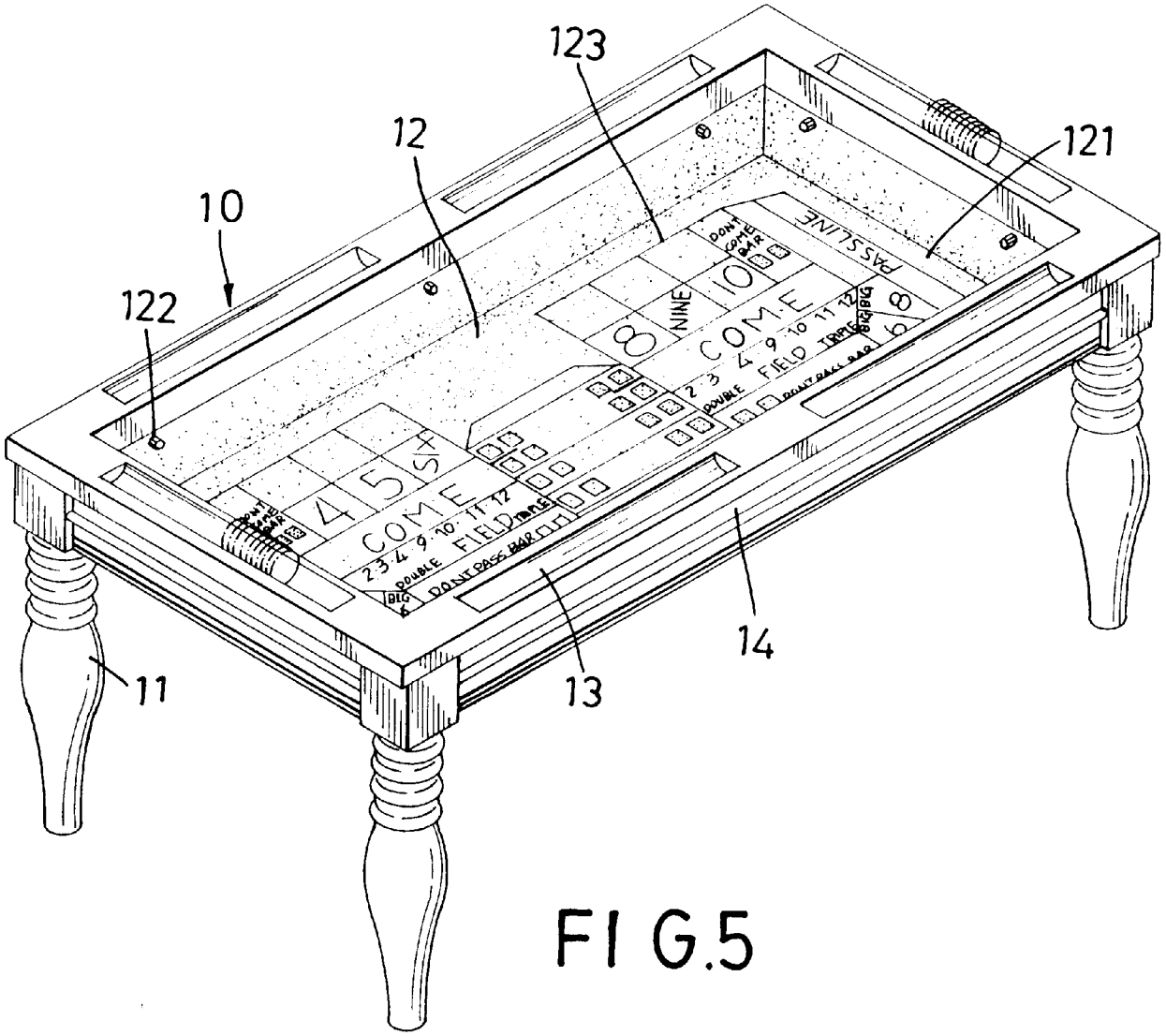
FIG. 5 illustrates still another use of the tabletop of the preferred embodiment.

In FIG. 5, there is shown still another use of the tabletop 10, wherein the board member 20 and the cover member 30 are removed, and an indoor game layout 123 is provided on the flannel layer 121 of the bottom wall 12 for playing still another indoor game on the tabletop 10.

Accordingly, when the cover member 30 is mounted on the surrounding wall 14 such that the board member 20 is supported and is received inside the base member, and such that the peripheral rim flange 31 of the cover member 30 engages the surrounding wall 14, a common table for general use, such as for making tea, for placing magazines and newspapers thereon, or for use as a coffee table, is formed. For entertainment, the cover member 30 of the tabletop 10 can be turned upside-down, as shown in FIG. 3, for playing a particular indoor game using the indoor game layout 321 on the cover member 30. Further, the cover member 30 can be removed for access to the indoor game layout 221, as shown in FIG. 4. By using the space above the board member 20 inside the base member, a wheel roulette can be mounted on the board member 20 so that a roulette game can be played. Alternatively, the board member 20 can be further removed from the base member. The space inside the base member is now suitable for playing a dice game with the aid of the indoor game layout 123 provided on the bottom wall 12 of the base member.

Accordingly, by using the tabletop 10 of this invention, multiple indoor games can be played on one table, thereby saving the space required for several game tables when playing diverse indoor games.

It should be understood that the above description is intended to be illustrative and not restrictive. A variety of modifications will be apparent to those skilled in the art within the sprit and scope of the invention as defined in the appended claims.

I claim:

1. A tabletop comprising:

a base member having a bottom wall provided with a first indoor game layout thereon, and a surrounding wall extending upwardly from a periphery of said bottom wall;

a cover member mounted detachably on top of said surrounding wall and having one side provided with a second indoor game layout;

a board member disposed removably inside said base member within said surrounding wall and having a third indoor game layout provided thereon; and supporting means for supporting removably said board member in a horizontal position inside said base member;

said one side of said cover member being formed with a peripheral rim flange for engaging removably the top of said surrounding wall when said cover member is mounted on top of said surrounding wall.

2. The tabletop as claimed in claim 1, wherein said supporting means includes a plurality of posts projecting inwardly from said surrounding wall for supporting said board member thereon.

3. The tabletop as claimed in claim 1, wherein said board member has opposite sides formed with a respective notch to facilitate removal of said board member from said base member.

4. The tabletop as claimed in claim 1, wherein said board member has a flannel layer which is secured thereon and which has said third indoor game layout provided thereon, each of said bottom wall and said one side of said cover member further having a flannel layer which is secured thereon and which has the respective one of said first and second indoor game layouts provided thereon.

5. The tabletop as claimed in claim 1, wherein said surrounding wall has a distal top end face formed with a number of cavities adapted for receiving tokens therein, said one side of said cover member being formed with a number of cavities aligned with said cavities on said surrounding wall and adapted for receiving the tokens therein.

* * * * *